US005187337A

United States Patent [19]

Fujie et al.

[11] Patent Number: 5,187,337

[45] Date of Patent: Feb. 16, 1993

[54] FLUID PRESSURE ACTUATED SWITCH FOR FLUID PUMP

[75] Inventors: Toru Fujie; Shigeyuki Hadama, both of Kanagawa, Japan

[73] Assignee: Atsugi Unisia Corporation, Atsugi, Japan

[21] Appl. No.: 779,971

[22] Filed: Oct. 21, 1991

[30] Foreign Application Priority Data

Oct. 23, 1990 [JP] Japan ..... 2-110194[U]

[51] Int. Cl.[5] ..... H01H 35/38

[52] U.S. Cl. ..... 200/82 R; 73/745; 200/820

[58] Field of Search ..... 92/5 R; 307/118; 73/744, 745; 200/82 R, 82 B, 82 D, 81 R, 83 N, 83 W

[56] References Cited

U.S. PATENT DOCUMENTS 2,742,544 4/1956 Lovick ..... 200/83 W
4,272,659 6/1981 Orzel ..... 200/82 D
4,932,841 6/1990 Havemann ..... 417/63
4,990,886 2/1991 Stanolis ..... 340/467

FOREIGN PATENT DOCUMENTS 58-141539 9/1958 Japan .
63-129934 8/1988 Japan .

*Primary Examiner*—Gerald P. Tolin
*Attorney, Agent, or Firm*—Bachman & LaPointe

[57] ABSTRACT

A pressure switch for operating a device for increasing the engine speed of an automotive vehicle equipped with a power steering system in order to prevent an engine stall when a high load acts on a power steering pump during parking and at a low vehicle cruising speed. The pressure switch is comprised of a movable terminal which is normally separate from a stationary terminal and contactable with the stationary terminal in response to an oil pressure over a predetermined level, in a hydraulic circuit of the power steering system. The movable terminal is slidably fitted in a pit to be filled with oil so that the response of the movable terminal to the oil pressure is lowered, thus providing a hysteresis effect to prevent chattering of the pressure switch.

9 Claims, 3 Drawing Sheets

FLUID PRESSURE ACTUATED SWITCH FOR FLUID PUMP

BACKGROUND OF THE INVENTION

1. The field of the Invention

This invention relates to improvements in a pressure (operated) switch adapted to open and close in response to a pressure within a pressure circuit including a fluid pump used, for example, in an automotive power steering system.

2. The description of the Prior Art

A variety of hydraulic (oil) pumps have been proposed and put into practical use for automotive vehicle power steering systems. Typical ones of them are of rotary volume type oil pumps such as vane-type oil pumps. Such pumps are usually driven by an engine and arranged to rise in rotational speed to increase the discharge amount of oil as the engine speed increases. The pump forms part of a hydraulic circuit for generating a steering assisting power in the power steering system. More specifically, in the hydraulic circuit, the flow amount of oil from the pump is controlled by a flow control valve and then supplied to a power cylinder to assist steering.

The amount of oil to be supplied to the power cylinder corresponds to the magnitude of a steering assist force generated depending on the hydraulic fluid amount. In other words, the steering assist force is relatively increased when a steering wheel is turned during parking or during a low speed vehicle cruising, whereas it is relatively decreased when the steering wheel is turned during a high speed vehicle cruising. This is realized by arranging the flow control valve such that the flow amount of oil to be supplied to the power cylinder is decreased during the high speed vehicle cruising in which the pump rotational speed is relatively high. In this regard, the flow control valve has a so-called flow-down function to decrease the supply amount of oil when the rotational speed of the pump reaches a predetermined level, thereby supplying a required amount of the hydraulic pressure to the power cylinder in accordance with a required magnitude of the steering assist power without being affected by a rotational speed change of the pump or a pressure variation at a part of the hydraulic circuit leading to the power cylinder.

Additionally, the hydraulic circuit of the power steering system is provided with a pressure (operated) switch which is switched ON when the pressure within the hydraulic circuit exceeds a predetermined level upon an increase of load applied to the pump under an operation of the power steering. Such an increase of the pressure may cause an engine stall. When the pressure switch is switched ON, a device is operated to increase the engine speed of the engine mounted on the automotive vehicle.

An example of such a conventional pressure switch will be discussed with reference to FIGS. 4 and 5. The conventional pressure switch includes a switch housing 30 threadedly fitted in a bore of a support base. A stationary terminal 31 is fixedly supported by the switch housing 30. A movable terminal 32 is movably disposed in low pressure chamber to be contactable with the stationary terminal 31. The movable terminal 32 is biased by a spring 33 to separate from the stationary terminal 31. The movable terminal 32 is fixedly provided with a pressure receiving piston or pin 34 to which an oil pressure in a part 40 of a hydraulic circuit acts, so that the oil pressure is transmitted through the piston 34 to the movable terminal 32. The movable terminal 32 is kept separate from the stationary terminal 31 under a normal condition in which the oil pressure in the hydraulic circuit is lower than a predetermined level.

Thus, the part 40 serves as a high pressure chamber whereas a chamber in which the movable terminal 32 is disposed serves as a low pressure chamber. Accordingly, the movable terminal 32 is moved in response to the pressure difference between the high and low pressure chambers, and is brought into contact with the stationary terminal 31 when the oil pressure in the high pressure chamber 40 reaches the predetermined level. As a result, the pressure switch is switched ON or closed to operate a required device.

However, drawbacks have been encountered in the above discussed conventional pressure switch as set forth below. An operational oil pressure by which switching of the pressure switch is made is unavoidably determined only in response to the pressure difference between the high and low pressure chambers. In other words, there is no difference in the operational oil pressure between a time the pressure switch is switched ON and a time it is switched OFF, thus never providing a so-called hysteresis effect by which a delay is made when the pressure switch changes from its ON to OFF operations.

Accordingly, in case that such a pressure switch is used in combination with a power steering system in such a manner that the above-mentioned device is operated to increase the engine speed when the pressure switch is switched ON, the hysteresis effect cannot be obtained between the operational oil pressures of switching ON and OFF the pressure switch. Accordingly, if the oil pressure to be applied to the movable terminal frequently changes near the operational oil pressures, the pressure switch repeats its ON and OFF operations thereby causing chattering. Additionally, this frequently repeatedly puts the engine speed increasing device in its operative or inoperative state, thereby causing a large engine speed fluctuation.

SUMMARY OF THE INVENTION

It is an object of the present invention to provide an improved pressure switch which can effectively overcome the drawbacks encountered in conventional pressure switches.

Another object of the present invention is to provide an improved pressure switch which is stable in its operation avoiding generation of chattering even if pressure changes occur when the pressure switch makes its ON switching operation.

A further object of the present invention is to provide an improved pressure switch which has an operational characteristics having the hysteresis in which there is a difference in operational oil pressures between a time the pressure switch is switched ON and a time it is switched OFF.

A still further object of the present invention is to provide an improved pressure switch which can prevent a large engine speed fluctuation in case of being used in switching a device for increasing the engine speed, provided in a power steering system.

A pressure switch of the present invention is comprised of a stationary terminal fixedly secured to a support base to which the pressure switch is installed. A movable terminal is disposed movable relative to the support base and contactable with the stationary terminal. The movable terminal being normally kept separate from the stationary terminal. A pressure receiving piston is fixedly connected to the movable terminal and adapted to receive a pressure in a pressure circuit. The movable terminal and at least a part of the stationary terminal are disposed in a chamber. A pit is formed contiguous with the chamber. A part of the movable terminal is slidably fitted in the pit in a manner that an orifice is formable between the movable terminal and a member defining the chamber. The chamber and the pit are communicable with each other through the orifice.

Accordingly, the instant the pressure switch makes its OFF operation, movement of fluid cannot be momentarily carried out from a space between the movable terminal and the surface of the pit to the chamber, thereby causing a hysteresis effect by which a delay is made when the pressure switch changes from its ON to OFF operations. As a result, the pressure switch stably operates without bringing about chattering even if frequent pressure changes are made in the pressure circuit.

DETAILED DESCRIPTION OF THE DRAWINGS

Figure 1:
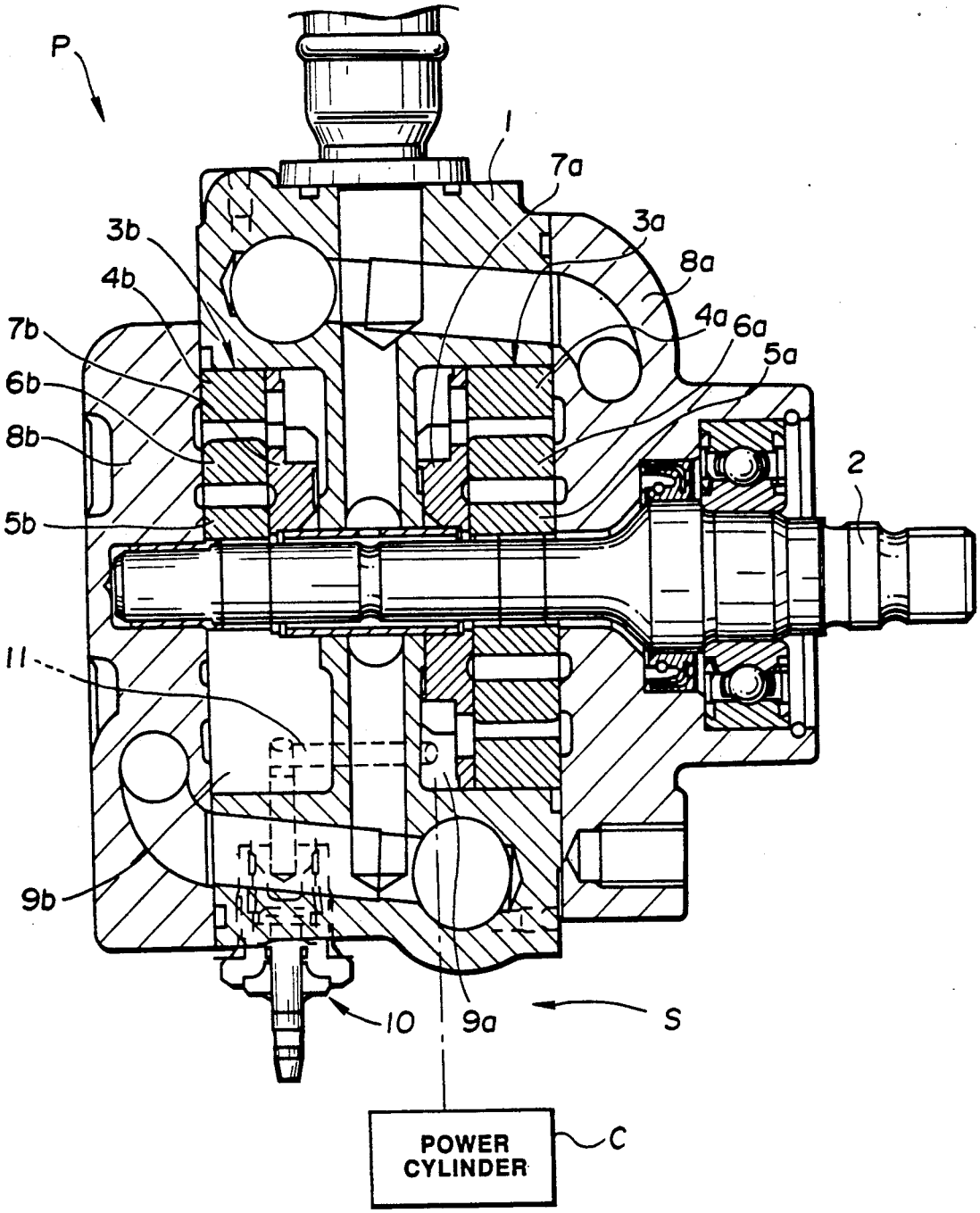
FIG. 1 is a cross-sectional view of a fluid (oil) pump on which an embodiment of a pressure switch according to the present invention is mounted.
Figure 2:
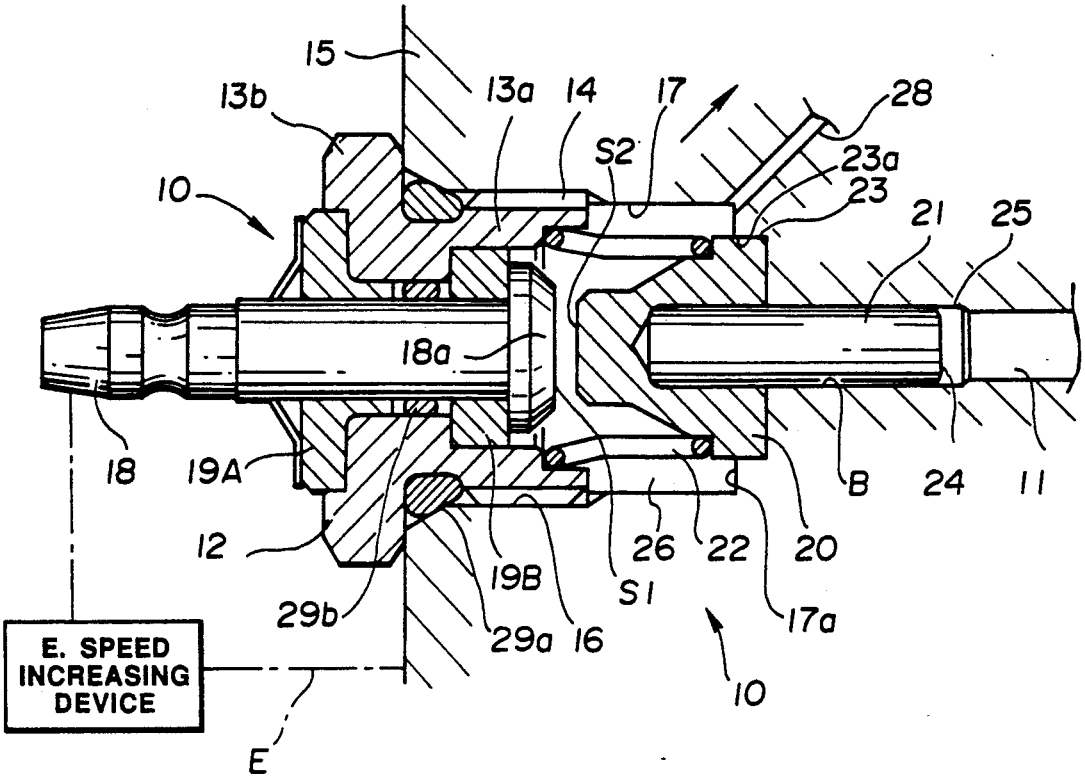
FIG. 2 is an enlarged sectional view of the pressure switch of FIG. 1, showing an operational mode of the pressure switch.
Figure 3:
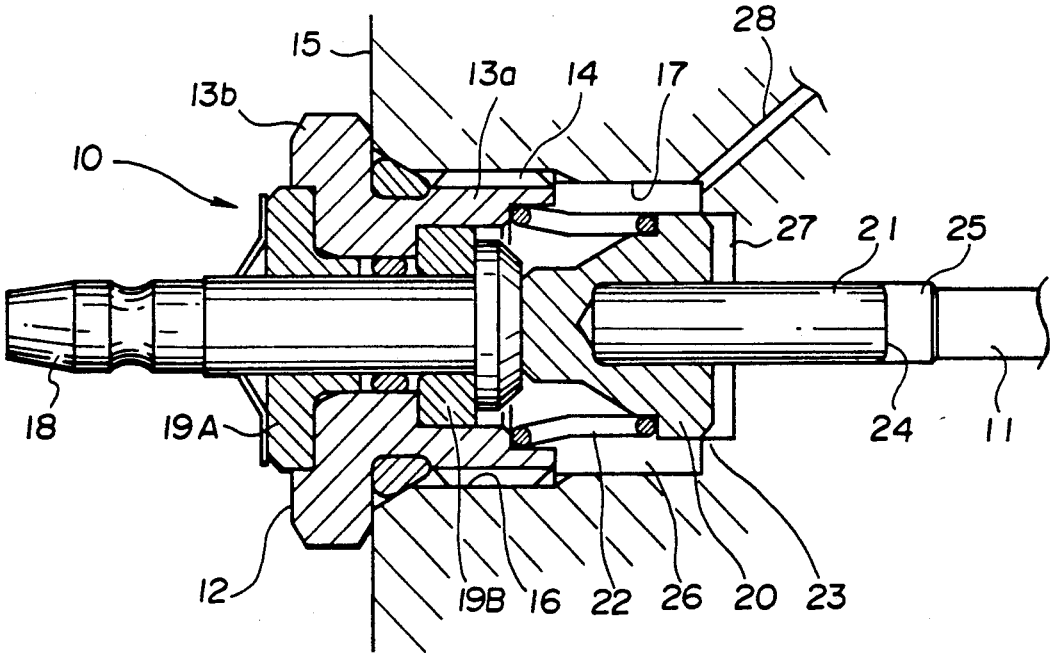
FIG. 3 is an enlarged sectional view similar to FIG. 2 but showing another operational mode of the pressure switch of FIG. 1.
Figure 4:
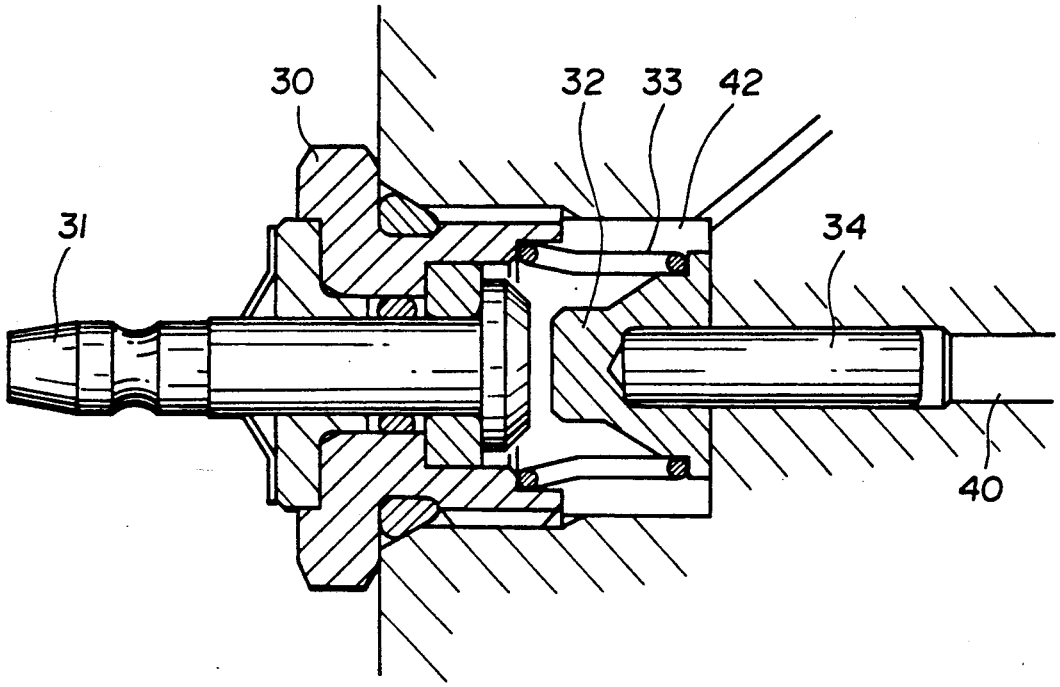
FIG. 4 (PRIOR ART)
FIG. 4 is an enlarged sectional view of a conventional pressure switch, showing an operational mode of the pressure switch.
Figure 5:
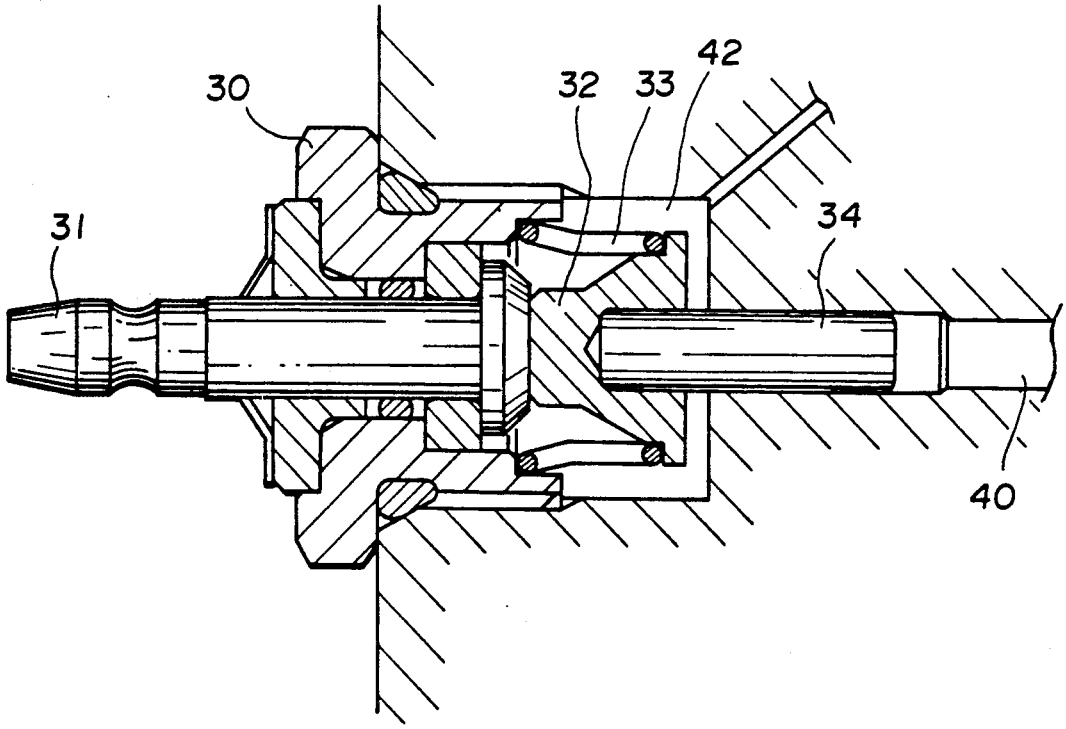
FIG. 5 (PRIOR ART)
FIG. 5 is an enlarged sectional view similar to FIG. 4 but showing another operational mode of the conventional pressure switch.

Referring now to FIGS. 1 to 3, more particularly to FIG. 1, an embodiment of a pressure (operated) switch 10 according to the present invention is illustrated by the reference numeral 10. The pressure switch 10 is incorporated with an engine-driven fluid (oil) pump P mounted on an automotive vehicle. The pump P includes a main pump section 3*a* which forms part of a power steering system S and arranged to develop a hydraulic (oil) pressure which is supplied to a power cylinder C to assist steering, forming part of the power steering system S. The main pump section 3*a* includes a pump casing 1 inside which a cam ring 4*a* is disposed. A rotor 5*a* is rotatably disposed inside the cam ring 4*a* and mounted on a pump shaft 2, so that the rotor 5*a* is rotatably driven through the pump shaft 2 from an engine of the automotive vehicle. A plurality of vanes 6*a* are movably fitted respectively in grooves (not shown). The rotor 5*a* is rotatably disposed between a side plate 7*a* and a cover 8*a* fixedly secured to the casing 1.

The fluid pump P further includes a sub-pump section 3*b* which forms part of another system (not shown) such as a rear wheel steering system (not shown) by which rear wheels of the vehicle are controllably turned. The sub-pump section 3*b* is arranged to develop a hydraulic (oil) pressure to be supplied to a power cylinder (not shown) forming part of the system. The sub-pump section 3*b* includes another cam ring 4*b* disposed inside the casing 1. Another rotor 5*b* is rotatably disposed inside the cam ring 4*b* and fixedly mounted on the pump shaft 2. A plurality of another vanes 6*b* are movably fitted in grooves (not shown) of the rotor 5*b*. The rotor 5*b* is rotatably disposed between another side plate 7*b* and another cover 8*b* fixedly secured to the casing 1.

Accordingly, when the pump shaft 2 rotates under engine running, the vanes 6*a*, 6*b* project radially outwardly to come into slidable contact with the inner surface of the cam rings 4*a*, 4*b*, respectively, under the centrifugal force applied to each vane. As a result, the volume of a chamber defined between the adjacent vanes 6*a*, 6*a* (6*b*, 6*b*) is changed with the rotation of the rotor 5*a* (5*b*), thereby accomplishing a pumping function.

The pressure switch 10 is mounted on the pump P in a manner to be switched ON or closed in response to a hydraulic pressure in a high pressure chamber 9*a* of the main pump section 3*a*. It will be understood that hydraulic fluid (oil) is pressurized by the pump section 3*a* and then discharged through the high pressure chamber 9*a* out of the pump P to be supplied finally to the power cylinder C for assisting steering.

It is to be noted that when the pressure switch 10 is switched ON or closed, a device 45 for increasing the engine speed of the engine is operated. In other words, when the power steering system S is operated during a parking of the vehicle or at a low vehicle cruising speed, the load applied to the pump P (pump section 3*a*) is increased and therefore the hydraulic pressure in the high pressure chamber 9*a* rises over a predetermined level. Accordingly, the engine speed of the engine unavoidably further lowers since the engine speed is considerably low during the vehicle parking or at the low vehicle cruising speed, thereby providing the possibility of bringing about an engine stall. In this regard, the pressure switch 10 is switched ON or closed in response to the hydraulic or oil pressure (in the high pressure chamber 9*a*) over the predetermined level. Upon switching ON or closure of the pressure switch 10, the device 45 is operated to raise the engine speed thereby to previously prevent the engine stall.

As shown in FIGS. 2 and 3, the pressure switch 10 includes a generally cylindrical switch housing 12 made of metal. The switch housing 12 has a small-diameter section 13*a* formed with an external thread 14 which is in engagement with the internal thread 16 of a support base 15 to which the pressure switch 10 is installed. In this case, the member 15 is a part of the pump casing 1. The internal thread 16 is formed on the surface of a bore 17 of the pump casing 1. The small diameter section 13*a* is embedded in the support base 15. The switch housing 12 has a large diameter section 13*b* which is out of the support base 15 so that only the small diameter section 13*a* fits in the bore 17. Thus, the switch housing 12 is fixedly secured inside the bore 17 and therefore constitutes a stationary member (no numeral) in cooperation with the support base 15. An O-ring 29*a* is disposed between the switch housing 12 and the support base 15. Another O-ring 29*b* is disposed between the switch housing 12 and the stationary terminal 18.

A generally rod-like stationary terminal 18 is fixedly disposed inside the switch housing 12 through generally cylindrical insulators 19A and 19B. More specifically, the small diameter section of the insulator 19A is interposed between the switch housing 12 and the stationary terminal 18. The insulator 19B is also interposed between the switch housing 12 and the stationary terminal 18. The stationary terminal 18 has an enlarged head section 18*a* which is located inside the bore 17 and faces the bottom surface 17*a* of the bore 17. The head section has a flat end surface S1 perpendicular to the axis of the stationary terminal 18.

A generally frustoconical movable terminal 20 is movably disposed in the bore 17 and located such that the flat end face S2 of the movable terminal 20 faces the flat end surface S1 of the stationary terminal 18. The movable terminal 20 is normally separate from the stationary terminal 18 under the bias of a coil spring 22 disposed between the movable terminal 20 and the switch housing 12. The cylindrical large diameter end section (not identified) of the movable terminal 20 is slidably fitted in a generally flat cylindrical pit 23 formed at the bottom surface 17*a* of the bore 17. More specifically, the cylindrical peripheral surface of the large diameter end section of the movable terminal 20 is slidably movably contacted with the cylindrical wall 23*a* (of the member 15) defining the pit 23. It will be understood that the movable terminal 20 is movable within the pit 27 along the direction of the axis of the stationary terminal 18 so that the end face S2 of the movable contact 20 is contactable with the end face S1 of the stationary contact 18.

A pressure receiving piston 21 has an end section fixedly embedded in the movable contact 20 and located in a manner that its axis is generally aligned with the axis of the stationary contact 18. The piston 21 is slidably disposed in a bore B formed in the pump housing 1. The bore B communicates through an oil passage 11 with the high pressure chamber 9*a* of the pump P. The combined stationary terminal 20 and piston 21 constitute a movable member (not identified) which defines a high pressure chamber 25 in a part of the bore B leading to the oil passage 11 and a low pressure chamber 26 in the bore 17. The oil passage 11 forms part of a pressure or hydraulic (oil) circuit (not identified) including the pump section 3*a* and the power cylinder C. The low pressure chamber 26 communicates through a passage 28 with an oil (hydraulic fluid) reservoir (not shown) in which oil flowing through the fluid pump P is stored. It will be understood that the end face of the free end of the piston 21 serves as a pressure receiving surface 24 on which the hydraulic pressure from the pump high pressure chamber 9*a* acts. The movable terminal 20 is earthed through the piston 21 with the support base 15 or the pump casing 1, i.e., electrically connected through the piston 21 with the support base 15. Accordingly, under a condition where the stationary and movable terminals 18, 20 contact with each other, an electric circuit E is completed to operate the engine speed increasing device to increase the engine speed of the engine. It will be understood that the stationary and movable terminals and the pressure receiving piston 21 are formed of metallic materials thorough which electric current flows therethrough.

As will be appreciated, the movable terminal 20 is moved leftward in FIG. 2 and contacts with the stationary terminal 20 as shown in FIG. 3 when the pressure receiving piston 21 is moved leftward in response to the oil pressure higher than the predetermined level, in the high pressure chamber 25. At this time, oil in the low pressure chamber 26 flows into a space 27 defined between the surface of the pit 23 and the movable terminal 20, the space 27 serving as an oil sink. When the oil pressure within the high pressure chamber 25 lowers, the movable terminal 20 is moved rightward in FIG. 3 and comes into fit in the pit 23 thereby missing the space or oil sink 27 so that the oil in the space 27 returns into the low pressure chamber 26. At this time, discharge of oil from the space 27 into the low pressure chamber 26 is carried out through an orifice (not identified) formed between the movable terminal 20 and the wall defining the pit 23. As a result, the movable terminal 20 cannot momentarily return to its original position shown in FIG. 2, thereby producing a so-called hysteresis effect by which a time is required when the pressure switch 10 changes from its ON to OFF operations. In other words, a delay is made when the pressure switch 10 changes from its ON to OFF operations.

The manner of operation of the pressure switch 10 will be discussed hereinafter.

When the oil pressure in the oil passage 11 is lower the predetermined level, the movable terminal 20 is kept separate from the stationary terminal 18 under the bias of the spring 22 as shown in FIG. 2, so that the pressure switch 10 is kept switched OFF or opened.

When the oil pressure in the oil passage 11 becomes not lower than the predetermined level, a failure is made in a balance between a force (oil pressure) applied to the pressure receiving piston 21 and the total force of the biasing force of the spring 22 and the sliding resistance of the movable member. Accordingly, the movable terminal 21 moves leftward in FIG. 2 and takes a position shown in FIG. 3 so as to come into contact with the stationary terminal 18. As a result, the pressure switch 10 is switched ON or closed, thereby operating the engine speed increasing device to increase the engine speed. This effectively prevents an engine stall even during parking or at a low vehicle cruising speed.

In this condition in which the pressure switch 10 is being switched ON or closed, when the oil pressure in the oil passage 11 lowers to a value lower than the predetermined level, the biasing force of the spring 22 overcomes the total force of the pressure applied to the pressure receiving piston 21 and the sliding resistance of the movable member. Accordingly, the movable terminal 20 moves leftward in FIG. 3 to take a position shown in FIG. 2, thereby switching OFF or opening the pressure switch 10. During the movement of the movable terminal 20 from the position of FIG. 3 to the position of FIG. 2, oil in the space or oil sink 27 cannot immediately return to the low pressure chamber 26 under an orifice action made between the movable terminal 20 and the wall defining the pit 23, thereby developing the hysteresis effect. As a result, even if frequent pressure changes occur near the time the pressure switch 10 takes its ON operation, the pressure switch 10 can be prevented from making frequent changes between the ON and OFF operations, thus preventing generation of chattering of the pressure switch 10 while preventing a large engine speed fluctuation due to frequent intermittent operations of the device 45 for increasing the engine speed.

While the pressure sensor 10 has been shown and described as being used in the hydraulic circuit of the power steering system, it will be understood that the pressure sensor may be usable in the pressure circuit of a variety of systems.

Although the principle of the present invention has been shown and described as being applied to the embodiment having only one movable terminal, it will be appreciated that it may be applied to other types of pressure sensors such as one having a plurality of movable terminals as disclosed in Japanese Utility Model Provisional Publication No. 58-141539.

What is claimed is:

1. A pressure switch comprising:

a stationary terminal fixedly secured to a support base to which the pressure switch is installed;

a movable terminal which is movable relative to said support base and contactable with said stationary terminal, said movable terminal being normally kept separate from said stationary terminal;

a pressure receiving piston fixedly connected to said movable terminal and adapted to receive a pressure in a pressure circuit;

means defining a chamber in which said movable terminal and at least a part of said stationary terminal are disposed, said chamber being filled with a fluid;

means defining a pit in said chamber defining means contiguous with said chamber, a part of said movable terminal slidably fitting in said pit, a variable volume space between said pit defining means and said part of said movable terminal; and orifice means defined by said movable terminal and said pit defining means, said chamber and said space in said pit being communicable with each other through said orifice means, said fluid being flowable between said chamber and said space defined in said pit, in accordance with movement of said movable terminal.

2. A pressure switch comprising:

a stationary terminal fixedly secured to a support base to which the pressure switch is installed;

a movable terminal which is movable relative to said support base and has a first end section contactable with said stationary terminal, and a second end section located opposite to said first end section;

means for biasing said movable terminal in a direction to separate from said stationary terminal;

a pressure receiving piston fixedly connected to said movable terminal at the second end section to receive a fluid pressure in a pressure circuit;

means defining a chamber in which said movable terminal and at least a part of said stationary terminal are disposed, an incompressible fluid being filled in said chamber;

means defining a pit in said chamber defining means contiguous with said chamber;

means by which said second end section of said movable terminal is slidable within said pit, a variable volume space formed between a surface of said pit and the second end section of said movable terminal when said movable terminal is moved toward said stationary terminal; and orifice means defined by said second end section of said movable terminal and said pit defining means, said chamber and said space in said pit being communicable through said orifice, said incompressive fluid being flowable between said chamber and said space through said orifice, in accordance with movement of said movable terminal.

3. A pressure sensor as claimed in claim 2, wherein said biasing means is adapted to allow said movable terminal to contact with said stationary terminal when the fluid pressure applied to said pressure receiving piston exceeds a predetermined level.

4. A pressure sensor as claimed in claim 2, wherein said fluid is oil, wherein said fluid pressure is oil pressure.

5. A pressure sensor as claimed in claim 2, wherein said second end section of said movable terminal is generally cylindrical and coaxially arranged with said pressure receiving piston, wherein said pit is defined by a cylindrical wall of said chamber defining means, said cylindrical wall being coaxial with said movable terminal second end section so that a cylindrical peripheral surface of said movable terminal second end section is slidably contactable with said cylindrical wall.

6. A pressure sensor as claimed in claim 2, wherein said chamber defining means is a part of said support base, said chamber and said pit being formed in said part.

7. A pressure sensor as claimed in claim 2, further comprising a housing securely fitted in a bore formed in said support base, said chamber being part of said bore, said stationary terminal being fixedly supported by said housing so as to maintain a fluid tight seal between said stationary terminal and said housing.

8. A pressure switch comprising:

a stationary terminal fixedly secured to a support base to which the pressure switch is installed;

a movable terminal which is movable relative to said support base and contactable with said stationary terminal, said movable terminal being normally kept separate from said stationary terminal, said movable terminal being movable in a first direction to approach said stationary terminal and in a second direction to separate from said stationary terminal;

a pressure receiving piston fixedly connected to said movable terminal and adapted to receive a pressure in a pressure circuit;

means defining a chamber in which said movable terminal and at least a part of said stationary terminal are disposed, said chamber being filled with a fluid; and means for increasing a resistance to a movement of said movable terminal in said second direction relative to that in said first direction, said resistance increasing means including means defining a pit in said chamber defining means contiguous with said chamber, a part of said movable terminal slidable with in said pit, a variable volume space formed between said pit defining means and said part of said movable terminal, and orifice means defined by said movable terminal and said pit defining means, said chamber and said space in said pit being communicable with each other through said orifice, said fluid being flowable between said chamber and said space defined in said pit, in accordance with movement of said movable terminal.

9. A pressure switch comprising:

a stationary terminal fixedly secured to a support base to which the pressure switch is installed;

a movable terminal which is movable relative to said support base and has a first end section contactable with said stationary terminal, and a second end section located opposite to said first end section, said movable terminal being movable in a first direction to approach said stationary terminal and in a second direction to separate from said stationary terminal, said second end section having a cylindrical surface;

a spring for biasing said movable terminal in said second direction;

a pressure receiving piston fixedly connected to said movable terminal at the second end section to receive a fluid pressure in a pressure circuit;

means defining a chamber in which said movable terminal and at least a part of said stationary terminal are disposed, an incompressible fluid being filled in said chamber; and means for increasing a resistance to a movement of said movable terminal in said second direction relative to that in said first direction, said resistance increasing means including means defining a pit in said chamber defining means contiguous with said chamber, said pit having a cylindrical surface coaxial with said pressure receiving piston, said cylindrical surface of said movable terminal second end section being slidably contactable with said cylindrical surface of said pit, means by which said second end section of said movable terminal is slidable within said pit, a variable volume space formed between a surface of said pit and the second end section of said movable terminal when said movable terminal is moved toward said stationary terminal; and orifice means defined by said cylindrical surface of said second end section of said movable terminal and said cylindrical surface of said pit, said chamber and said space in said pit being communicable through said orifice, said incompressive fluid being flowable between said chamber and said space through said orifice, in accordance with movement of said movable terminal.

* * * * *